US005660797A

United States Patent [19]

Järvimäki

[11] Patent Number: 5,660,797

[45] Date of Patent: Aug. 26, 1997

[54] APPARATUS AND METHOD OF MAKING A PIPETTE RECEPTACLE

[75] Inventor: Kari Järvimäki, Espoo, Finland

[73] Assignee: Labsystems Oy, Helsinki, Finland

[21] Appl. No.: 424,462

[22] PCT Filed: Nov. 11, 1993

[86] PCT No.: PCT/FI93/00472

§ 371 Date: May 3, 1995

§ 102(e) Date: May 3, 1995

[87] PCT Pub. No.: WO94/11108

PCT Pub. Date: May 26, 1994

[30] Foreign Application Priority Data

Nov. 11, 1992 [FI] Finland ..... 925118

[51] Int. Cl.[6] ..... B01L 3/02

[52] U.S. Cl. ..... 422/100; 422/101; 422/104; 73/864.14; 73/864.15; 73/864.01; 436/180

[58] Field of Search ..... 422/100–104, 422/63; 436/54, 180; 73/864.01, 864.11, 864.14, 864.15; 604/280; 264/249, 248, 262; 425/577

[56] References Cited

U.S. PATENT DOCUMENTS

| | | | |
|---|---|---|---|
| 4,318,402 | 3/1982 | Vailancourt | 128/214.4 |
| 4,461,328 | 7/1984 | Kenney | 141/67 |
| 4,528,161 | 7/1985 | Eckert | 422/100 |
| 4,999,164 | 3/1991 | Puchinger et al. | 422/100 |
| 5,045,286 | 9/1991 | Kitajima et al. | 422/100 |
| 5,218,875 | 6/1993 | Volpe et al. | 73/864.01 |
| 5,232,669 | 8/1993 | Pardinas | 422/100 |
| 5,249,711 | 10/1993 | Filbert, Jr. | 222/189 |
| 5,312,577 | 5/1994 | Peterson et al. | 264/154 |

FOREIGN PATENT DOCUMENTS

| | | |
|---|---|---|
| 187167 | 7/1986 | European Pat. Off. . |
| 423719 | 4/1991 | European Pat. Off. . |

*Primary Examiner*—Harold Pyon

*Attorney, Agent, or Firm*—Armstrong, Westerman, Hattori, McLeland & Naughton

[57] ABSTRACT

A pipette receptacle, or tip, which is applied to the 'jet' or aspirate/blow tube of the pipette proper, wherein the receptacle has a top end with integral sections of a material different from the of the main body of the receptacle. These sections of different material can include an outer collar, an inner collar, or an entire upper portion. A color coding can be included. Additionally, methods of making the receptacle is disclosed.

26 Claims, 2 Drawing Sheets

APPARATUS AND METHOD OF MAKING A PIPETTE RECEPTACLE

FIELD OF THE INVENTION

The invention relates to laboratory technology and concerns pointed pipette receptacles and their manufacture.

BACKGROUND OF THE INVENTION

Pointed plastic receptacles into which the fluid to be pipetted is drawn have been used by laboratories for a long time in pipettes. This is known already at least in the printed German patent specification 1090449 (date of application Mar. 5, 1957). In the present day there are receptacles by tens of different manufacturers on the market.

All known pointed receptacles are always made of one material.

SUMMARY OF THE INVENTION

It has now been found that a plastic-based pointed receptacle for pipettes can be composed of several materials and that several advantages of various kinds may be achieved in this way.

Some plastic is also preferably used as additional material, though it may also be some other material, such as, for example, metal, glass or rubber.

The intended scope of protection is defined exactly in the appended claims.

BRIEF DESCRIPTION OF THE DRAWINGS

The invention and some advantageous embodiments of the same are described in greater detail in the following. In the drawings

DETAILED DESCRIPTION OF THE PREFERRED EMBODIMENTS

Figure 1:
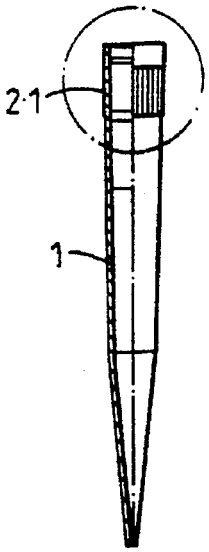
FIG. 1 shows a pointed receptacle.
Figure 2:
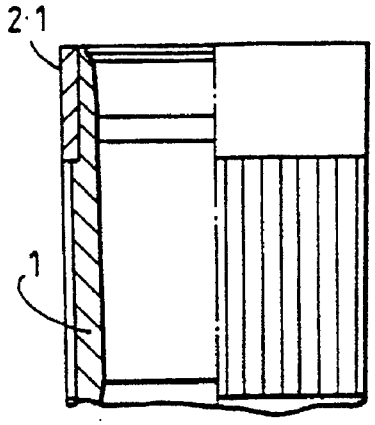
FIG. 2 is an enlarged top end view of the pointed receptacle of FIG. 1.

The pointed receptacle according to FIGS. 1 and 2 is manufactured from two separate materials in such a way that the main part of the receptacle consists of some conventional material 1, such as colorless polypropylene, and the top end of the receptacle is provided with a collar made of another material 2.1. The collar may be made of a plastic which is harder or more inflexible than the main body, whereby it will press the mouth tightly against the bottom point of the pipette when the receptacle is pushed into this. The collar may also be only differently colored than the main body of the receptacle, whereby the colored collar may indicate some characteristic of the receptacle, such as size, material, sterility etc.

Figure 3:
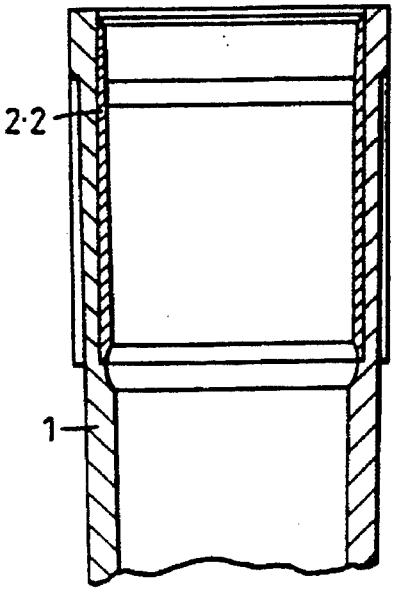
FIG. 3 is a top end view of another pointed receptacle.

The receptacle according to FIG. 3 is provided inside at its top end with a collar, which is of a softer material 2.2 than the main body 1 of the receptacle. The collar functions as a seal against the bottom point surface of the pipette.

Figure 4:
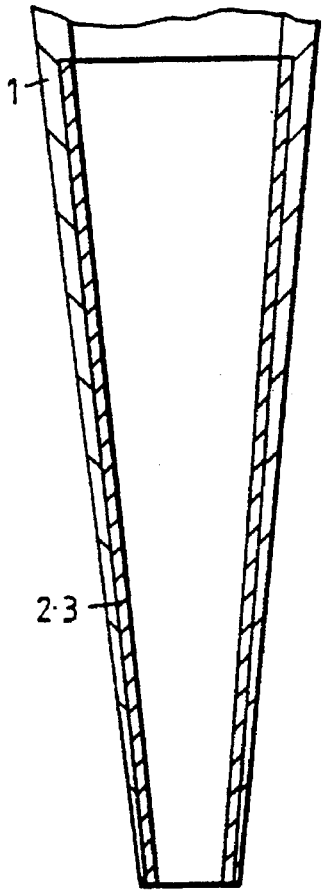
FIG. 4 is a bottom end view of a pointed receptacle.

The receptacle according to FIG. 4 is provided inside at the bottom end with an inner sleeve 2.3, which is of a strongly fluid-repellent material, such as polytetrafluoroethylene. The main body is made of some conventional material. The fluid-repellent bottom end of the receptacle promotes as complete emptying of the receptacle as possible.

The entire inside surface may also be coated with some special plastic or, for example, with metal. In this way e.g. chemical resistance or some other desired property may be obtained.

Figure 5:
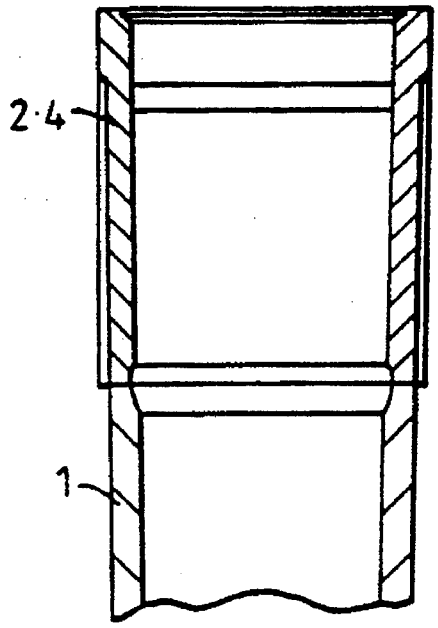
FIG. 5 is a top end view of a third pointed receptacle.

In the receptacle according to FIG. 5 the entire top end of the receptacle is of another material 2.4 than the main body. The top end material may be softer, for example, to promote sealing. It may be only of a different color to form a code. For example, rings of different colors can be made at suitable intervals over the whole length of the point to indicate different volumes.

Figure 6:
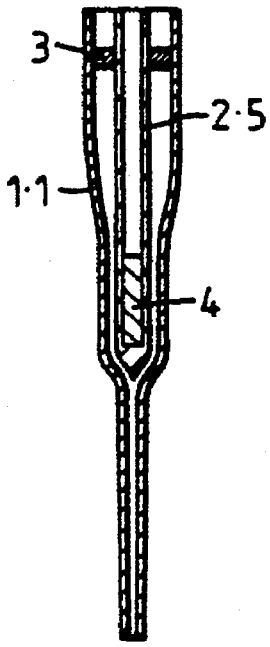
FIG. 6 shows a fourth pointed receptacle.

The receptacle according to FIG. 6 has an outer receptacle 1.1 and inside this there is a well-like cover 2.5 mounted on radial ribs 3. A magnet 4 is moved inside the cover. A fluid containing magnetic particles is drawn into the outer receptacle. The magnet pulls the particles to the surface of the cover, whereby the fluid free of particles can be removed. Another fluid is drawn into the receptacle and the magnet is moved upwards, whereby the particles are released. To make the separation of particles more efficient, the receptacle 1.1 and the cover 2.5 are of different materials. For example, the cover may be of a suitable paramagnetic material which makes the field more powerful.

The main part of the receptacle is made of a suitable polyalkene, such as polypropylene or polyethylene. The other material may also be a suitable polyalkene with the desired hardness, flexibility or other property.

In principle, the receptacle can be made by joining together various components of the receptacle made of different materials. However, it is preferable to use such an injection moulding technique which allows direct manufacture of plastic pieces consisting of several materials.

The receptacles can also be made by first making the whole receptacle of a suitable material, the characteristics of which can be changed by after-treatment. This method is especially suitable when making such receptacles which have a component of some harder plastic. Irradiation (for example, irradiation with electrons) is a particularly suitable hardening after-treatment. For example, the receptacle according to FIG. 5, which has a top end made of a harder material, can be made of some plastic which is hardened by irradiation. In the irradiation process harden-ing of the bottom part is then prevented, for example, by protecting it with a lead jacket.

I claim:

1. A pipette receptacle, comprising:

a tubular member made of a plastic material and tapering from a top end of a first diameter to a bottom end of a second, smaller diameter, wherein said top end has a top opening for slidingly mounting around a pipette and said bottom end has a bottom opening for drawing and expelling a fluid therethrough;

an inner collar having a back surface entirely in contact with an inside surface of said tubular member at said top end of said tubular member proximate said top opening;

said inner collar being made from a material which is different than said plastic material of said tubular member, said material of said inner collar being softer and more flexible than said plastic material of said tubular member so as to promote sealing of said inner collar surrounding said pipette by a friction fit.

2. A pipette receptacle, comprising:

a tubular member made of a plastic material and tapering from a top end with a first diameter to a bottom end with a second smaller diameter, wherein said top end has a top opening for slidingly mounting around a pipette and said bottom end has a bottom opening for drawing and expelling a fluid therethrough;

a co-axial collar having a top end and a bottom end such that said bottom end of said co-axial collar is attached to said top end of said tubular member at said top opening, said co-axial collar extending away from said top end of said tubular member and said top end of said co-axial collar having a radially outwardly flaring flange means for ensuring that said top end of said co-axial collar surrounds said pipette in a friction fitting female-male connection, respectively;

said co-axial collar being made from a material which is different than said plastic material of said tubular member, said material of said co-axial collar being harder and more inflexible than said plastic material of said tubular member.

3. A pipette receptacle, comprising:

a tubular member made of a plastic material and tapering from a top end with a first diameter to a bottom end with a second smaller diameter, wherein said top end has a top opening for slidingly mounting around a pipette and said bottom end has a bottom opening for drawing and expelling a fluid therethrough;

a co-axial collar attached to said top end of said tubular member at said top opening such that said co-axial collar extends from said bottom end of said tubular member and at said top end of said co-axial collar is a radially outwardly flaring flange means for ensuring that said top end of said co-axial collar surrounds said pipette in a friction fitting female-male connection, respectively;

said co-axial collar being made from a material which is different than said plastic material of said tubular member, said material of said co-axial collar being softer and more flexible than said plastic material of said tubular member so as to promote sealing of said co-axial collar surrounding said pipette.

4. A pipette receptacle, comprising:

a tubular member made of a plastic material and tapering from a top end with a first diameter to a bottom end with a second smaller diameter, wherein said top end has a top opening for slidingly mounting around a pipette and said bottom end has a bottom opening for drawing and expelling a fluid therethrough;

an outer collar surrounding an outside surface of said tubular member at a top end of said tubular member proximate said top opening such that a back surface of said outer collar entirely contacts said outside surface of said tubular member;

said outer collar being made from a material which is differently colored than said plastic material of said tubular member, whereby said outer collar can indicate a characteristic of said pipette receptacle.

5. The pipette receptacle of claim 4, wherein said material of said outer collar has a color and said plastic material of said tubular member is substantially colorless.

6. The pipette receptacle of claim 5, wherein said collar and said tubular member are integrally formed with each other into a one-piece structure by injection molding.

7. A pipette receptacle, comprising:

a tubular member made of a plastic material and a top end with a first diameter to a bottom end with a second smaller diameter, wherein said top end has a top opening for slidingly mounting around a pipette and said bottom end has a bottom opening for drawing and expelling a fluid therethrough;

an outer collar surrounding an outside surface of said tubular member at said top end of said tubular member proximate said top opening such that a back surface of said outer collar entirely contacts said outside surface of said tubular member;

said outer collar being made from a material which is different than said plastic material of said tubular member, said material of said outer collar being harder and more inflexible than said plastic material of said tubular member.

8. The pipette receptacle of claim 7 wherein said material of said outer collar is a second plastic material which is harder or more inflexible than said plastic material of said tubular member.

9. The pipette receptacle of claim 8, wherein said plastic material of said tubular member is polypropylene.

10. The pipette receptacle of claim 7, wherein said material of said outer collar has a color and said plastic material of said tubular member is substantially colorless.

11. The pipette receptacle of claim 10, wherein said collar and said tubular member are integrally formed with each other into a one-piece structure by injection molding.

12. A method of making a pipette receptacle, comprising the steps of:

a) providing a tubular member made of a plastic material and having a top end and a bottom end, wherein said top end has a top opening for slidingly mounting around a pipette and said bottom end has a bottom opening for drawing and expelling a fluid therethrough, said tubular member being tapered from said top opening with a first diameter towards said bottom opening with a second smaller diameter;

b) providing an inner collar member made from a material which is different than said plastic material of said tubular member, said material of said inner collar being softer and more flexible than said plastic material of said tubular member so as to promote sealing;

c) locating said inner collar member so that a back surface of said inner collar member entirely contacts an inside surface of said tubular member at said top end of said tubular member proximate said top opening.

13. The method of claim 12, wherein said step a) is conducted separately from said step b) and in said step c) said inner collar member and said tubular member are joined together.

14. The method of claim 12, wherein said step a) is conducted simultaneously with both of said step b) and said step c) by integrally forming said inner collar member and said tubular member by an injection molding process.

15. A method of making a pipette receptacle, comprising the steps of:

a) providing a tubular member made of a plastic material and having a top end and a bottom end, wherein said top end has a top opening for slidingly mounting around a pipette and said bottom end has a bottom opening for drawing and expelling a fluid therethrough, said tubular member being tapered from said top opening with a first diameter towards said bottom opening with a second smaller diameter;

b) providing a co-axial collar member made from a material which is different than said plastic material of said tubular member, said material of said co-axial collar member being harder and more inflexible than said plastic material of said tubular member;

c) locating said co-axial collar member so as to be attached to said top end of said tubular member at said top opening such that said co-axial collar member extends from said top end of said tubular member.

16. The method of claim 15, wherein said step a) is conducted simultaneously with both of said step b) and said step c) by integrally forming said co-axial collar member and said tubular member by an injection molding process.

17. A method of making a pipette receptacle, comprising the steps of:

a) providing a tubular member made of a plastic material and having a top end and a bottom end, wherein said top end has a top opening for slidingly mounting around a pipette and said bottom end has a bottom opening for drawing and expelling a fluid therethrough, said tubular member being tapered from said top opening with a first diameter towards said bottom opening with a second smaller diameter;

b) providing a co-axial collar member made from a material which is different than said plastic material of said tubular member, said material of said co-axial collar member being softer and more flexible than said plastic material of said tubular member so as to promote sealing; and c) locating said co-axial collar member so as to be attached to said top end of said tubular member at said top opening such that said co-axial collar member extends from said top end of said tubular member.

18. The method of claim 17, wherein said step a) is conducted simultaneously with both of said step b) and said step c) by integrally forming said co-axial collar member and said tubular member by an injection molding process.

19. A method of making a pipette receptacle, comprising the steps of:

a) providing a tubular member made of a plastic material and having a top end and a bottom end, wherein said top end has a top opening for slidingly mounting around a pipette and said bottom end has a bottom opening for drawing and expelling a fluid therethrough, said tubular member being tapered from said top opening with a first diameter towards said bottom opening with a second smaller diameter;

b) providing an outer collar member made from a material which is differently colored than said plastic material of said tubular member, whereby said outer collar member indicates a characteristic of said pipette receptacle;

c) locating said outer collar member so as to surround an outside surface of said tubular member at said top end of said tubular member proximate said top opening.

20. The method of claim 19, wherein said steps a) and b) include providing said material of said outer collar member has a color and said plastic material of said tubular member as substantially colorless.

21. The method of claim 19, wherein said step c) includes injection molding said outer collar member and said tubular member together.

22. The pipette receptacle of claim 21, wherein said material of said outer collar member has a color and said plastic material of said tubular member is substantially colorless.

23. The pipette receptacle of claim 22, wherein said outer collar member and said tubular member are injected molded.

24. A method of making a pipette receptacle, comprising the steps of:

a) providing a tubular member made of a plastic material and having a top end and a bottom end, wherein said top end has a top opening for slidingly mounting around a pipette and said bottom end has a bottom opening for drawing and expelling a fluid therethrough, said tubular member being tapered from said top opening with a first diameter towards said bottom opening with a second smaller diameter;

b) providing an outer collar member from a material which is different than said plastic material of said tubular member, said material of said outer collar member being harder and more inflexible than said plastic material of said tubular member;

c) locating said outer collar member so as to surround an outside surface of said tubular member at a top end of said tubular member proximate said top opening.

25. The method of claim 24, wherein said step b) includes providing said material of said outer collar member from a second plastic material which is harder and more inflexible than said plastic material of said tubular member.

26. The method of claim 24, wherein said step a) further includes providing said plastic material of said tubular member to be polypropylene.

* * * * *